US005913700A

United States Patent [19]

Tobey et al.

[11] Patent Number: 5,913,700

[45] Date of Patent: Jun. 22, 1999

[54] CARD EDGE CONNECTOR HAVING LOW INDUCTANCE CONTACT SYSTEM

[75] Inventors: Shawn Phillip Tobey, Trinity, N.C.; Steve Phuc Chau; Steven Jay Millard, both of Mechanicsburg, Pa.; Roger Lee Thrush, Clemmons, N.C.

[73] Assignee: The Whitaker Corporation, Wilmington, Del.

[21] Appl. No.: 08/892,543

[22] Filed: Jul. 14, 1997

[51] Int. Cl.[6] ..... H01R 23/70

[52] U.S. Cl. ..... 439/637; 439/515

[58] Field of Search ..... 439/637, 636, 439/515, 862

[56] References Cited

U.S. PATENT DOCUMENTS

| | | | |
|---|---|---|---|
| 4,087,151 | 5/1978 | Robert et al. | 439/176 |
| 4,159,160 | 6/1979 | Plyler et al. | 439/217 |
| 4,268,102 | 5/1981 | Grabbe | 339/75 |
| 4,354,729 | 10/1982 | Grabbe et al. | 339/258 |
| 4,511,197 | 4/1985 | Grabbe et al. | 339/17 |
| 4,513,353 | 4/1985 | Bakermans et al. | 361/399 |
| 4,684,184 | 8/1987 | Grabbe et al. | 439/64 |
| 4,699,593 | 10/1987 | Grabbe et al. | 439/71 |
| 4,906,194 | 3/1990 | Grabbe | 439/71 |
| 4,927,369 | 5/1990 | Grabbe et al. | 439/66 |
| 5,620,342 | 4/1997 | Kinross | 439/637 |
| 5,653,598 | 8/1997 | Grabbe | 439/66 |
| 5,676,555 | 10/1997 | Yu et al. | 439/157 |

*Primary Examiner*—Neil Abrams
*Assistant Examiner*—Jean F. Duverne
*Attorney, Agent, or Firm*—Robert J. Kapalka

[57] ABSTRACT

An electrical connector for interconnecting a circuit card to a substrate includes a dielectric housing having an elongated slot which is open for receiving an edge portion of the circuit card, and a plurality of contacts which are spaced-apart along a length of the slot. Each of the contacts has a base portion, a lead extending from the housing for connection with a circuit path on the substrate, and a contact arm having a contact surface which extends into the slot for engaging a respective contact pad on the circuit card. An electrical path through each contact is defined from the contact surface to the lead, the electrical path being relatively long when the contact is undeflected. The contact arm has a free end which engages the base portion of the contact during insertion of the circuit card into the slot, wherein a relatively shorter electrical path through the contact is defined from the contact surface to the lead.

4 Claims, 3 Drawing Sheets

CARD EDGE CONNECTOR HAVING LOW INDUCTANCE CONTACT SYSTEM

FIELD OF THE INVENTION

The invention relates to a card edge electrical connector having contacts that provide a low inductance system suitable for high electrical speed applications.

BACKGROUND OF THE INVENTION

U.S. Pat. No. 5,620,342 discloses a type of card edge connector for interconnecting a dual in-line memory module (DIMM) to a motherboard. The connector has a slot which receives an edge of the memory module, and a plurality of contacts which extend into the slot for electrically connecting with contact pads along the edge of the module. The contacts are deflected when the module is installed in the slot, whereby the contacts exert a normal force on the module. Different modules may vary in thickness, and the contacts must be designed to exert a prescribed normal force on the different modules without overstressing any part of the contact. Therefore, the contacts have been configured with a wavy or sinuous shape in order to provide sufficient resiliency without being overstressed. The sinuous shape results in a relatively long electrical path length through the contact, thereby increasing the electrical inductance of the contact. The effects of inductance become greater as electrical frequencies increase and, due to the trend to operate electronic equipment at ever-higher frequencies, inductance has become a significant problem. There is a need to minimize the inductance of the contacts while permitting sufficient resiliency to avoid overstress.

SUMMARY OF THE INVENTION

The invention is an electrical connector for interconnecting a circuit card to a substrate. The connector comprises a dielectric housing having an elongated slot which is open for receiving an edge portion of the circuit card, and a plurality of contacts which are spaced-apart along a length of the slot. Each of the contacts has a base portion, a lead extending from the housing for connection with a circuit path on the substrate, and a contact arm having a contact surface which extends into the slot for engaging a respective contact pad on the circuit card. An electrical path through the contact is defined from the contact surface to the lead, the electrical path being relatively long when the contact is undeflected. The contact arm has a free end which engages the base portion of the contact during insertion of the circuit card into the slot, wherein a relatively shorter electrical path through the contact is defined from the contact surface to the lead.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
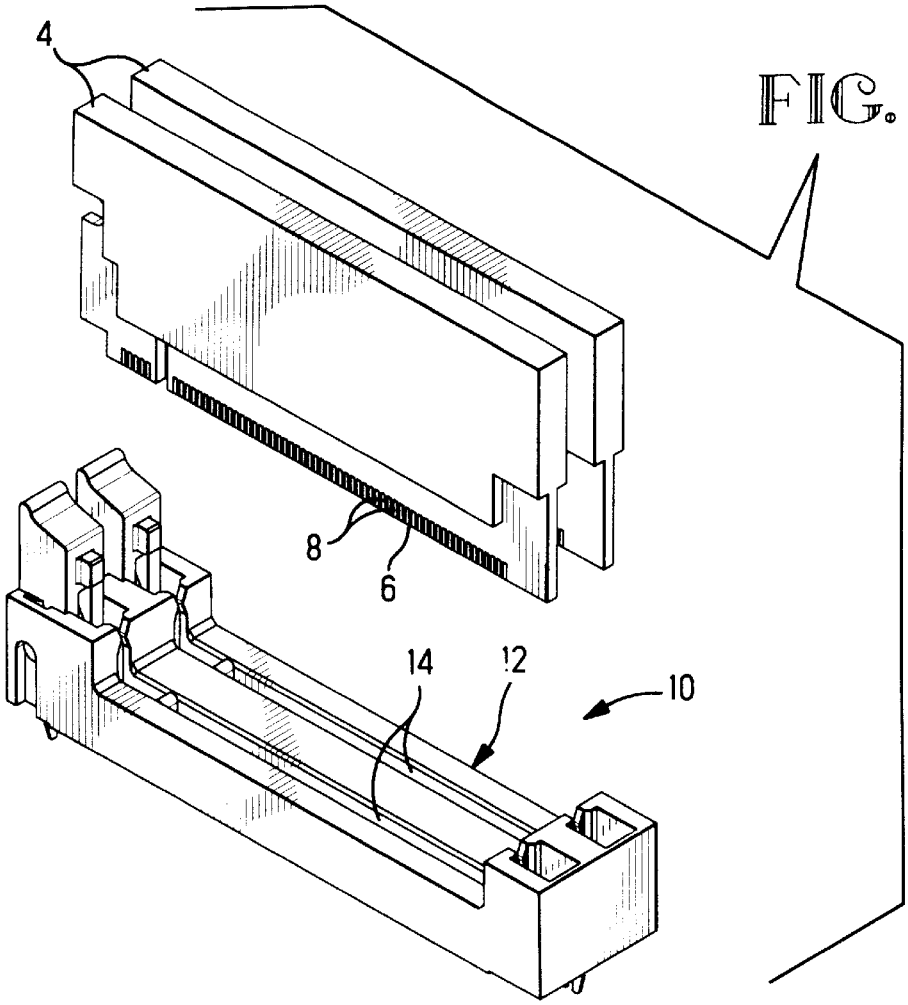
FIG. 1 is an isometric view of an electrical connector according to the invention and a pair of circuit cards disposed for insertion therein.
Figure 2:
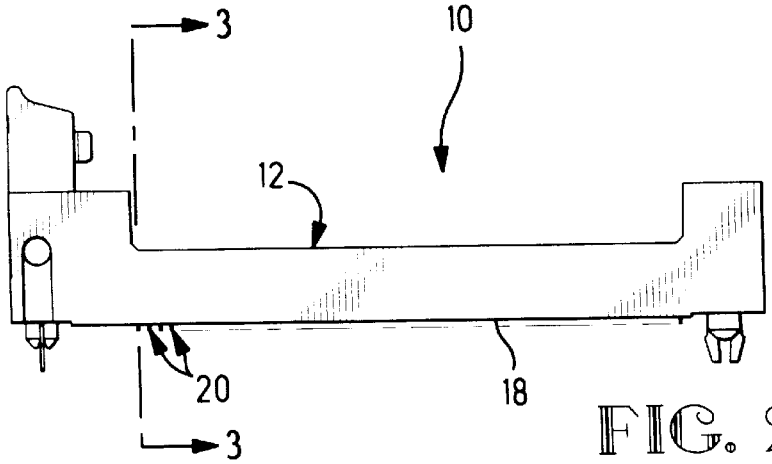
FIG. 2 is a front view of the connector.
Figure 3:
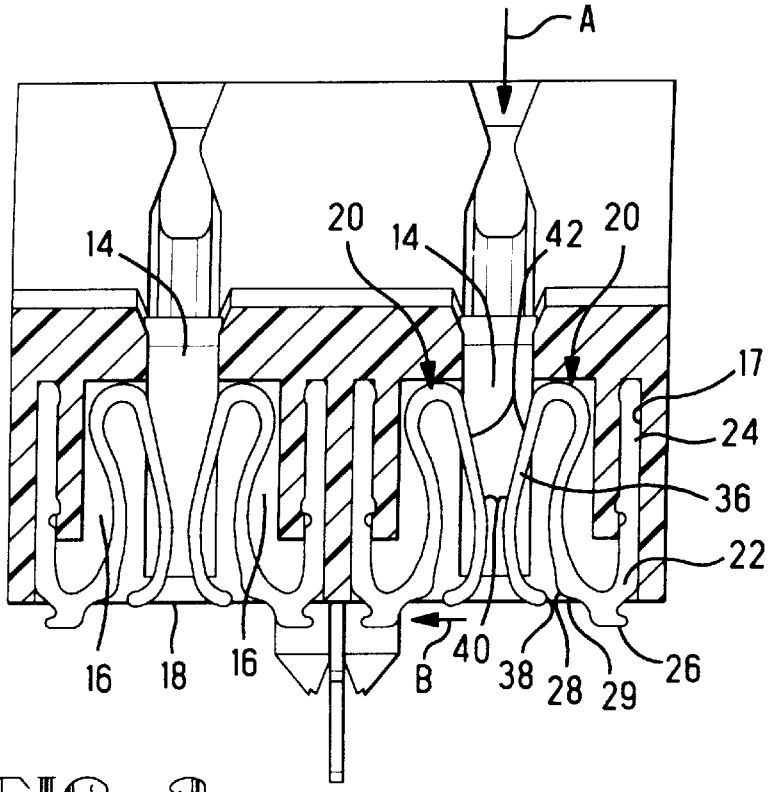
FIG. 3 is a cross-sectional view taken along line 3—3 of FIG. 2 showing contacts in the connector in an undeflected condition.

There is shown in FIGS. 1–3 a card edge-type electrical connector 10 for interconnecting a pair of circuit cards 4 such as dual in-line memory modules (DIMM's) to a circuit board or other substrate (not shown). The connector 10 includes a dielectric housing 12 having a pair of elongated slots 14 which are upwardly open for receiving respective leading edge portions 6 of the circuit cards 4 that have contact pads 8 therealong. The housing carries a plurality of electrically-conductive contacts 20 which are arranged in rows along both sides of each slot 14, the contacts in each row being spaced-apart along the length of each slot. The contacts 20 are installed in respective cavities 16 in the housing through a bottom surface 18 of the housing.

Figure 4:
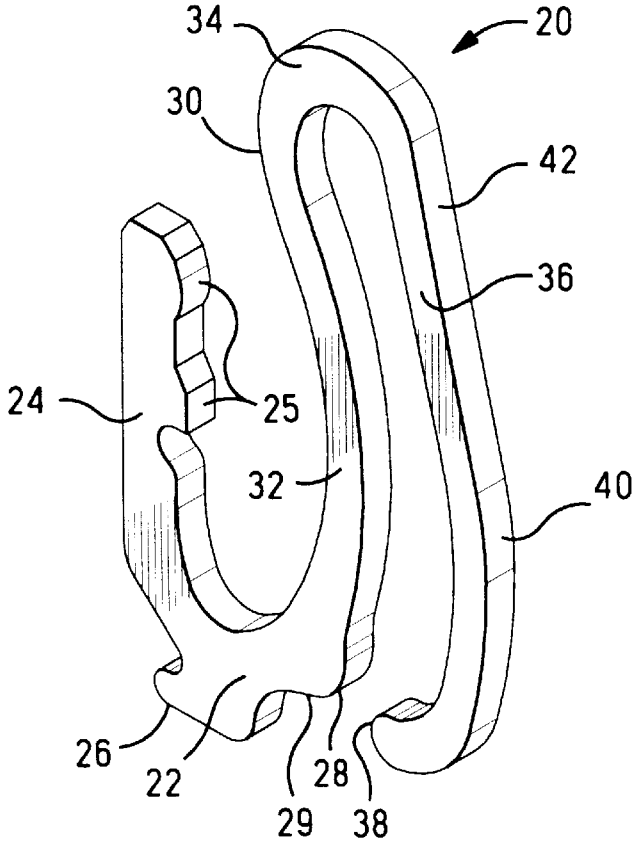
FIG. 4 is an isometric view of a contact used in the connector.

With reference to FIGS. 3 and 4, each of the contacts 20 is edge-stamped from electrically conductive sheet material. The contact 20 has a base portion or root 22 through which other major portions of the contact are interconnected. A rigid retention post 24 extends upwardly from one end of the base portion 22, a lead 26 in the form of a surface mount foot extends from a bottom of the base portion, and a contact loop portion 30 extends from the other end of the base.

The retention post 24 is configured with locking projections 25 and is interference fitted in a chamber 17 in the housing in order to secure the contact in the housing.

The lead 26 extends externally of the housing below the bottom surface 18 for engaging a respective circuit path on the substrate.

The contact loop portion 30 extends from the base 22 along a course which includes a substantially rigid main beam 32 that extends generally upwardly, a reverse loop 34, and a resilient contact arm 36 that extends generally downwardly to a free end 38. The contact arm 36 extends into the slot 14 and includes a contact surface 40 that engages a respective contact pad 8 (FIG. 1) on the circuit card which is received in the slot. The contact arm 36 is deflected when the circuit card is installed in the slot, and some of this deflection is transmitted throughout the contact loop portion 30. The contact loop portion 30 is configured with multiple curves and is dimensioned such that the contact arm 36 can deflect sufficiently to accommodate circuit cards of different thickness while maintaining desired resiliency characteristics so that a desired normal force is exerted on the circuit card and no segment of the contact loop portion is overstressed during the deflection.

Figure 5:
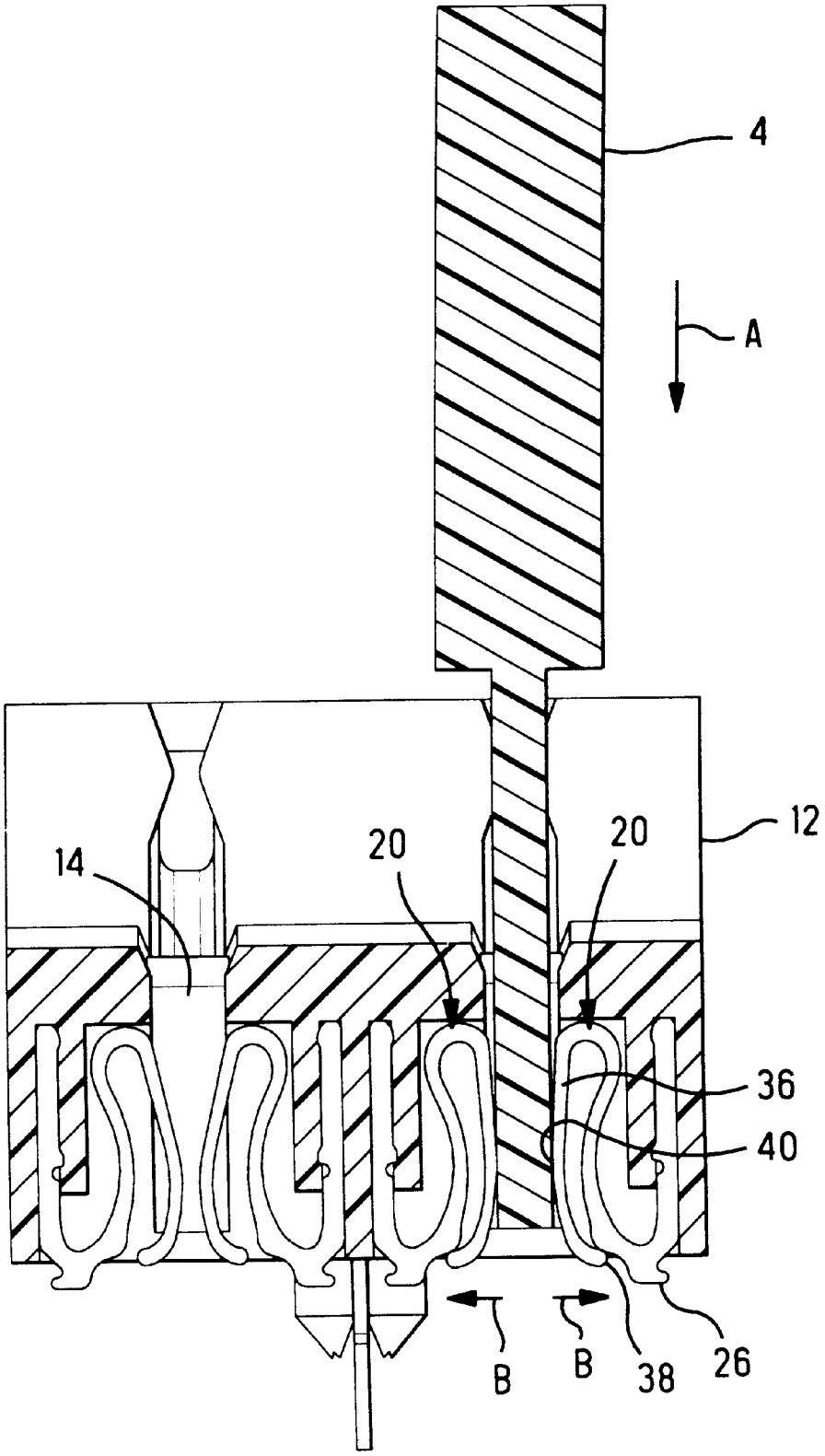
FIG. 5 is a cross-sectional view showing a circuit card installed in the connector and a pair of contacts in a deflected condition.

The contact loop portion 30 is initially open in an undeflected condition as shown in FIG. 3. Initially an electrical path is defined in the contact loop portion 30 from the contact surface 40 through the reverse loop 34 and the main beam 32 to the lead 26. When a circuit card 4 is inserted into the connector along a card insertion direction A, the leading edge of the circuit card first engages the contact arm 36 along lead-in surface 42 and begins to deflect the contact arm so that the free end 38 is moved toward the base portion 22 in a direction B that is substantially transverse to the card insertion direction A. Continued insertion of the card and deflection of the contact arm brings the free end 38 into engagement with a nose 28 of the base portion 22, as shown in FIG. 5, thereby forming the contact loop portion 30 into a closed loop. This closed loop provides a shortened electrical path which bypasses a major portion of the resilient portion 30, the shortened electrical path extending from the contact surface 40 through the free end 38 and the nose 28 to the lead 26. Engagement of the nose 28 by the free end 38 results in a rapid rise in normal force on the free end 38 and a corresponding rapid rise in the normal force which is exerted by the contact arm 36 on the circuit card. The nose 28 of the base portion 22 has a downwardly facing surface 29 which is inclined with respect to the transverse direction B of the free end. Further insertion of the card causes the free end 38 to be slidingly guided along the downwardly facing surface 29, thereby preventing the free end from locking up so that normal force on the circuit card is kept within a desired range when a relatively thick circuit card is installed in the connector.

It should be noted that as the contact arm 36 is deflected it pivots about an axis extending through the reverse loop 34. Since the free end 38 is further than the contact surface 40 from the reverse loop 34, the free end travels further than the contact surface as the contact arm deflects. Also, the free end 38 is relatively lower than the contact surface 40 with respect to the downward insertion direction of the circuit card 4 into the slot 14.

The invention provides a card edge connector having resilient contacts that can accommodate circuit cards which vary in thickness over a wide tolerance range. An electrical path through the contacts is relatively long when the contacts are undeflected, and the electrical path is shortened when the contacts are deflected by a circuit card in the connector. The shortened electrical path gives the advantage of reducing the inductance of contacts, thereby permitting the connector to be used in equipment operating at higher electrical speeds.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector for interconnecting a circuit card to a substrate, the electrical connector comprising:

a dielectric housing having an elongated slot which is upwardly open for receiving an edge portion of the circuit card, and a plurality of contacts spaced-apart along a length of the slot, each of the contacts having a base portion, a lead extending from the housing for connection with a circuit path on the substrate, and a contact arm having a contact surface which extends into the slot for engaging a respective contact pad on the circuit card, wherein an electrical path through the contact is defined from the contact surface to the lead, and the contact arm having a free end which is spaced from the base portion of the contact, the base portion has a downwardly facing surface, the free end engages the downwardly facing surface during insertion of the circuit card into the slot, wherein a relatively shorter electrical path through the contact is defined from the contact surface to the lead, and the free end is slidable along the downwardly facing surface, thereby preventing lock-up of the free end against the base portion.

2. The electrical connector according to claim 1, wherein the free end of the contact arm is deflected in a transverse direction and the downwardly facing surface is inclined with respect to the transverse direction.

3. The electrical connector according to claim 1, wherein the contact has a contact loop portion including a main beam that extends upwardly from the base portion and the contact arm that extends downwardly to the free end.

4. The electrical connector according to claim 1, wherein the circuit card is insertable downwardly into the slot and the free end of the contact arm is relatively lower than the contact surface.

* * * * *